US010443454B2

(12) United States Patent
Bauer et al.

(10) Patent No.: US 10,443,454 B2
(45) Date of Patent: Oct. 15, 2019

(54) VALVE DRIVE DEVICE FOR AN INTERNAL COMBUSTION ENGINE

(71) Applicant: Daimler AG, Stuttgart (DE)

(72) Inventors: Juergen Bauer, Korb (DE); Matthias Lahr, Schwaebisch Gmuend (DE); Marc Oliver Wagner, Esslingen am Neckar (DE); Benjamin Zeller, Kornwestheim (DE)

(73) Assignee: Daimler AG, Stuttgart (DE)

( * ) Notice: Subject to any disclaimer, the term of this patent is extended or adjusted under 35 U.S.C. 154(b) by 89 days.

(21) Appl. No.: 15/539,053

(22) PCT Filed: Dec. 2, 2015

(86) PCT No.: PCT/EP2015/002421

§ 371 (c)(1),
(2) Date: Jun. 22, 2017

(87) PCT Pub. No.: WO2016/102042

PCT Pub. Date: Jun. 30, 2016

(65) Prior Publication Data

US 2017/0362964 A1 Dec. 21, 2017

(30) Foreign Application Priority Data

Dec. 23, 2014 (DE) ..... 10 2014 019 573

(51) Int. Cl.
*F01L 1/04* (2006.01)
*F01L 13/06* (2006.01)
(Continued)

(52) U.S. Cl.
CPC ..... *F01L 1/047* (2013.01); *F01L 1/04* (2013.01); *F01L 13/0036* (2013.01);
(Continued)

(58) Field of Classification Search
CPC ... F01L 1/047; F01L 13/06; F01L 1/04; F01L 13/0036; F01L 2001/0473; F01L 2013/0052; F01L 2820/031
(Continued)

(56) References Cited

U.S. PATENT DOCUMENTS 5,289,806 A * 3/1994 Hurr ..... F01L 1/267 123/90.17
8,474,424 B2 7/2013 Meintschel et al.
2011/0079188 A1* 4/2011 Meintschel ..... F01L 13/0036 123/90.15

FOREIGN PATENT DOCUMENTS

CN 100577991 C 1/2010
CN 104136724 A 11/2014
(Continued)

OTHER PUBLICATIONS

German Search Report issued in German counterpart application No. 10 2014 019 573.2 dated Nov. 22, 2017, with Statement of Relevancy (Twelve (12) pages).
(Continued)

*Primary Examiner* — Jorge L Leon, Jr.
*Assistant Examiner* — Wesley G Harris
(74) *Attorney, Agent, or Firm* — Crowell & Moring LLP

(57) ABSTRACT

A valve drive device for an internal combustion engine is disclosed. The valve drive device has an axially displaceable cam element and an adjusting device with a first engagement element which displaces the cam element axially into a first switching position and a second engagement element which displaces the cam element axially into a second switching position. The adjusting device has a first slotted guide track in which the first engagement element is guided in the first switching position and a second slotted guide track in which the second engagement element is guided in the second switching position. The first engagement element is posi-
(Continued)

tively coupled to the second engagement element. The adjusting device includes a triggering device which holds the first engagement element fixedly in the second switching position counter to a restoring force. A method for axial displacement of a rotating cam element is also disclosed.

9 Claims, 9 Drawing Sheets

(51) Int. Cl.
*F01L 1/047* (2006.01)
*F01L 13/00* (2006.01)

(52) U.S. Cl.
CPC ..... *F01L 13/06* (2013.01); *F01L 2001/0473* (2013.01); *F01L 2013/0052* (2013.01)

(58) Field of Classification Search
USPC ..... 123/90.18, 90.15, 90.16
See application file for complete search history.

(56) References Cited

FOREIGN PATENT DOCUMENTS

| | | | |
|---|---|---|---|
| DE | 10 2007 048 915 | A1 | 4/2009 |
| DE | 10 2008 029 325 | A1 | 12/2009 |
| DE | 10 2011 076 276 | A1 | 11/2012 |
| JP | 2010-249123 | A | 11/2010 |
| JP | 2011-524493 | A | 9/2011 |
| JP | 2013-133809 | A | 7/2013 |
| JP | 2013-139739 | A | 7/2013 |
| JP | 2014-31745 | A | 2/2014 |
| JP | 2014-224496 | A | 12/2014 |

OTHER PUBLICATIONS

Japanese Office Action issued in Japanese counterpart application No. 2017-531880 dated Feb. 20, 2018, with partial English translation (Four (4) pages).
PCT/EP2015/002421, International Search Report dated Mar. 10, 2016 (Two (2) pages).
Chinese Office Action issued in Chinese counterpart application No. 201580070164.4 dated Oct. 8, 2018, with partial English translation (Nine (9) pages).

* cited by examiner

IV

VALVE DRIVE DEVICE FOR AN INTERNAL COMBUSTION ENGINE

BACKGROUND AND SUMMARY OF THE INVENTION

The invention relates to a valve drive device for an internal combustion engine, to an internal combustion engine with an engine brake, and to a method for operating the valve drive device.

A valve drive device for an internal combustion engine is already known from DE 10 2007 048 915 A1. The valve drive device comprises an axially displaceable cam element and an adjusting device. The adjusting device comprises a first engagement element that is provided for the purpose of displacing the cam element axially into a first switching position. Furthermore, the adjusting device comprises a second engagement element that is provided for the purpose of displacing the cam element axially into a second switching position. The adjusting device has a first slotted guide track in which the first engagement element is guided in the first switching position. Moreover, the adjusting device has a second slotted guide track in which the second engagement element is guided in the second switching position. The first engagement element is embodied so as to be positively coupled with the second engagement element.

It is particularly the object of the invention to provide especially reliable operation of an internal combustion engine.

The invention starts from a valve drive device for an internal combustion engine with an axially displaceable cam element and with an adjusting device comprising a first engagement element that is provided for the purpose of displacing the cam element axially into a first switching position and comprising a second engagement element that is provided for the purpose of displacing the cam element axially into a second switching position, with the adjusting device having a first slotted guide track in which the first engagement element is guided in the first switching position and a second slotted guide track in which the second engagement element is guided in the second switching position, and with the first engagement element being embodied so as to be positively coupled with the second engagement element.

It is proposed that the adjusting device comprise a triggering device that is provided for the purpose of detaining the first engagement element in the second switching position against a restoring force. Especially reliable engine operation, particularly including in the event of the failure of the triggering device, can thus be achieved. Additional triggering devices can be advantageously avoided. Furthermore, especially reliable frequent switching position changes can be performed, which is especially advantageous for an engine brake of a braking force machine, particularly of a heavy goods vehicle. The valve drive device is preferably provided for an internal combustion engine of a heavy goods vehicle.

The cam element is preferably supported so as to be rotatable and axially displaceable. A "rotatably and displaceably supported cam element" is to be understood in particular as being a cam element that is mounted in such a way as to be rotatable and axially displaceable in relation to a cylinder head or another stationarily arranged component of the internal combustion engine. Preferably, a support member receives the cam element in a rotatable manner and can be displaced axially, particularly together with the cam element, and is supported in an axially displaceable manner in the cylinder head. The term "axial" refers in particular to a main axis of rotation of the cam element, so the expression "axial" designates particularly a direction that extends parallel or coaxial to the main axis of rotation. Furthermore, the term "radial" refers in particular to the main axis of rotation of the cam element, so the expression "radial" designates particularly a direction that extends perpendicular to the main axis of rotation.

The cam element can be preferably displaced axially in order to change the valve lift. "Valve lift changeover" is intended particularly to refer to discrete switching between at least two valve actuation curves that define the actuation of at least one charge-cycle valve. A "cam element" is intended particularly to refer to an element that has at least one cam for actuating a charge-cycle valve. Preferably, only the first engagement element is provided for the axial displacement of the cam element in two opposite directions. In this context, a "first switching position" is to be understood particularly as an operating position. In this context, a "second switching position" is to be understood particularly as a trigger position and/or an engine-braking position. The restoring force is preferably at least substantially constant. The term "provided" is to be understood particularly as meaning specially embodied, laid out, equipped or arranged.

In another embodiment of the invention, it is proposed that the triggering device comprise an electromagnet that is provided for the purpose of detaining the first engagement element in the second switching position against the restoring force. Advantageously, the triggering device is provided for the purpose of providing a release force that extends radially starting from the cam element. In this way, an especially lasting and quick activation and/or maintaining of the second switching position can be achieved. This is especially advantageous if the valve drive device is used for an engine braking process.

Moreover, it is proposed that the triggering device comprise a return spring that is provided in order to exert the restoring force on the first engagement element in the direction of the first slotted guide track. Preferably, the return spring forms a helical compression spring. It is also advantageous for the restoring force to be aligned radially in the direction of the cam element. In this way, the first switching position can be advantageously activated and/or maintained without an external energy input. If the electromagnet fails, the first switching position can be reliably assumed.

Moreover, it is proposed that the return spring be provided for the purpose of guiding the first engagement element, after the electromagnet is switched off, into the first slotted guide track in order to perform a switching operation into the first switching position. In the event of an electrical malfunction of the electromagnet, operation can thus be advantageously continued in the first switching position. Advantageously, no external energy, such as electrical energy, is required to perform the switching operation into the first switching position.

Furthermore, it is proposed that the first slotted guide track be provided for the purpose of moving the first engagement element in an oscillating manner in a radial direction of the cam element when the cam element rotates in the first switching position. Preferably, the first slotted guide track has different distances to the main axis of rotation of the cam element when seen over a peripheral profile. The first engagement element can be advantageously advanced as a function of an angle of rotation of the cam element. Increased operational reliability can be advantageously achieved in this way.

In addition, it is proposed that the first engagement element be arranged in such a way in relation to the triggering device that the restoring force in a portion of the range of motion of the first engagement element than a release force of the triggering device acting on the first engagement element. "Release force" is to be understood in this context particularly as referring to a holding force and/or a magnetic force, particularly an attracting magnetic force. "Portion of the range of motion" is to be understood in this context particularly as referring to a part of a maximum possible displacement range. The triggering device preferably acts on the first engagement element only in a close range with a greater release force than the restoring force. A switching operation in an unwanted angle-of-rotation position of the cam element can thus be advantageously prevented. Advantageously, the triggering device can also be time-controlled in an imprecise manner and/or independently of an angle-of-rotation position of the cam element.

Moreover, it is proposed that the adjusting device comprise a lever element that supports the first engagement element and the second engagement element about a common swivel axis. Preferably, the swivel axis runs parallel to the main axis of rotation of the cam element. As a result, in a simple structural embodiment, a movement of the second engagement element can be coupled with the first engagement element. Additional triggering devices can be advantageously avoided. Synchronization between a movement of the first engagement element and a movement of the second engagement element can be achieved in an especially operationally reliable and durable manner.

Furthermore, it is proposed that the valve drive device comprise a camshaft for supporting the cam element in a rotationally fixed manner, with the adjusting device being arranged on a free longitudinal end of the camshaft. The valve drive device can thus be integrated with particular ease into an internal combustion engine. In this context, "free longitudinal end" is intended to refer particularly to a free end with respect to the main axis of extension of an element.

Moreover, an internal combustion engine with an engine brake having a valve drive device according to the invention is proposed. Here, the cam element can be switched with especially high frequency in order to reliably activate an engine brake.

Furthermore, a method for axially displacing a rotating cam element in two opposite directions from a first switching position into a second switching position with an adjusting device is proposed, with a first engagement element being positively coupled with a second engagement element, and with the first engagement element being detained by a triggering device in the second switching position against a restoring force. An especially high level of operational reliability can be achieved in this manner.

Additional advantages follow from the following description of the figures. FIGS. 1 to 9 show an exemplary embodiment of the invention. The drawings, the description of the figures and the claims contain numerous features in combination. A person skilled in the art will also view the features individually as proves expedient and group them together into other sensible combinations.

DETAILED DESCRIPTION OF THE DRAWINGS

Figure 1:
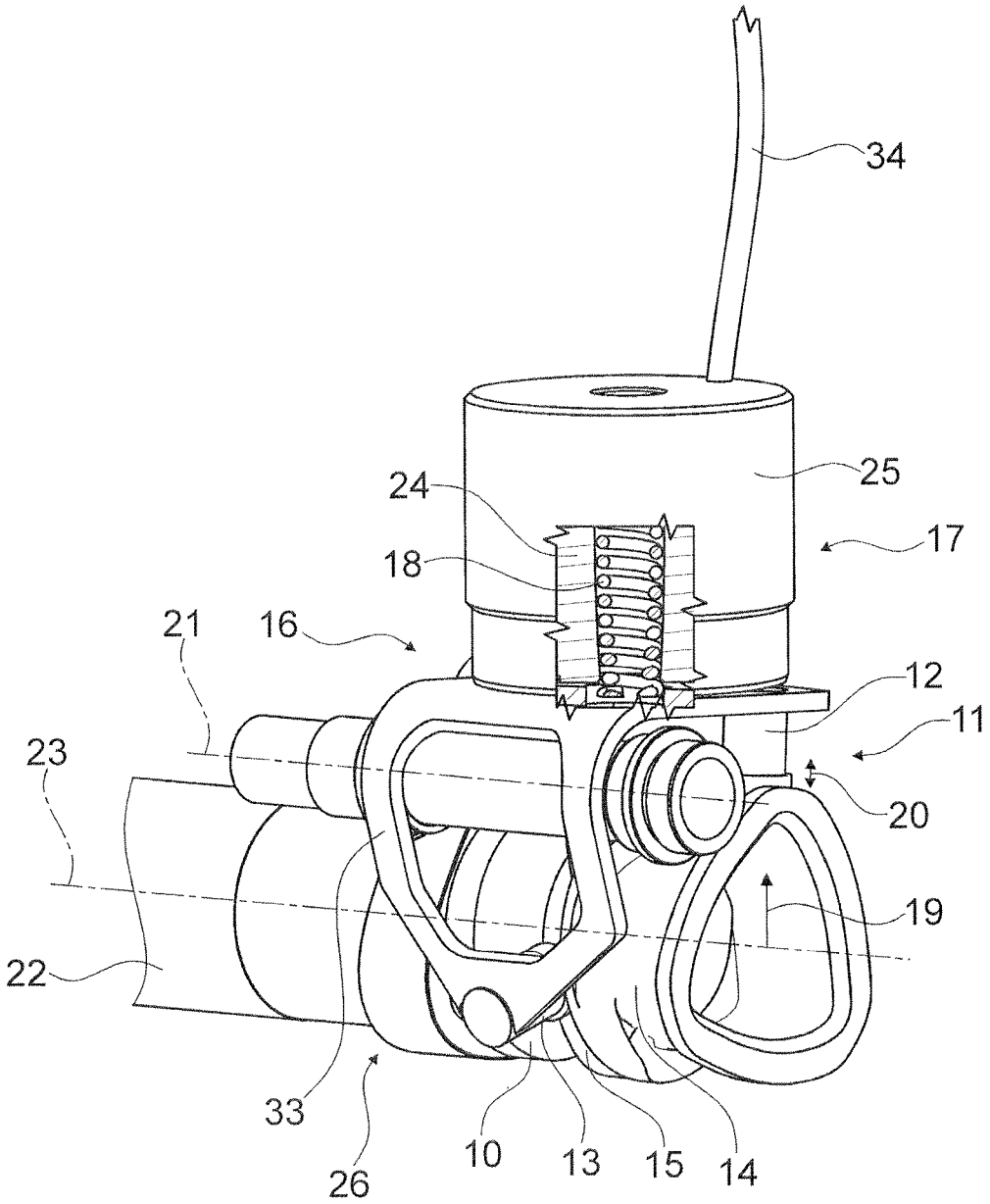
FIG. 1 shows an isometric view of a valve drive device.
Figure 2:
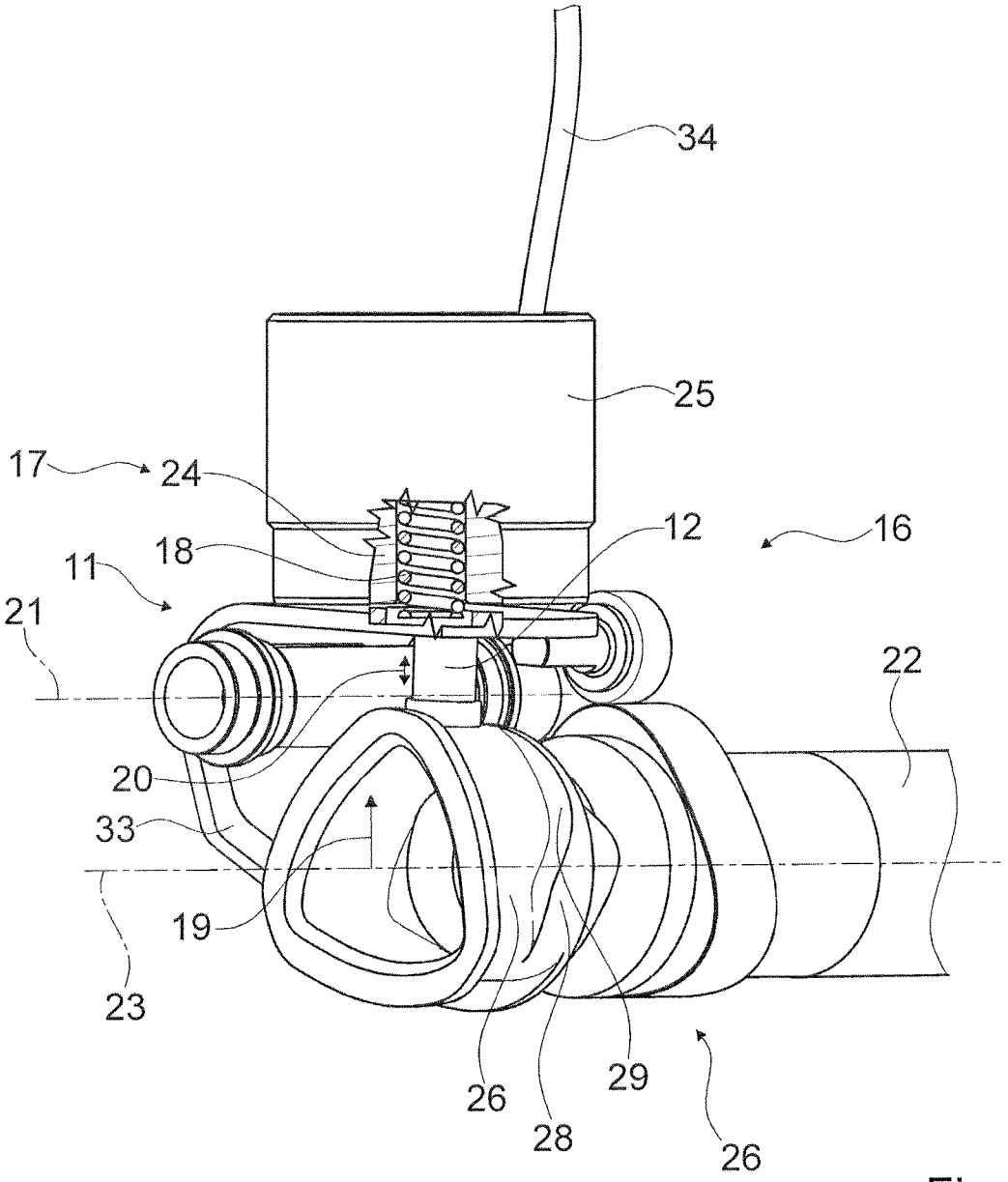
FIG. 2 shows an additional isometric view of the valve drive device.

FIGS. 1 and 2 show a valve drive device for an internal combustion engine, which is not shown in further detail. The internal combustion engine has an engine brake. The valve drive device comprises an axially displaceable cam element 10. The valve drive device has a camshaft 22. The camshaft 22 is provided in order to support the cam element 10 in a rotationally fixed manner. For this purpose, the cam element 10 is attached in a rotationally fixed manner to the camshaft 22. The cam element 10 is supported so as to be rotatable about a main axis of rotation 23. The camshaft 22 is supported so as to be rotatable about the main axis of rotation 23. The camshaft 22 has two differently structured cams (not shown). However, the different cams have the same base-circle radius. Each of the different cams is provided for different operating modes, such as, in particular, for a firing mode and an engine-braking mode.

The valve drive device has an adjusting device 11. The adjusting device 11 comprises a first engagement element 12. The first engagement element 12 is provided for the purpose of displacing the cam element 10 axially into a first switching position. The first engagement element 12 is cylindrical.

The adjusting device 11 has a first slotted guide track 14. The first slotted guide track 14 has different segments. One segment forms a first single-tracked segment. Another segment forms a first adjusting segment 28. A first engagement segment 27 runs in the circumferential direction and has three raised areas that are offset by 120° in the circumferential direction. The first slotted guide track thus has different distances to the main axis of rotation 23 of the cam element 10 when seen over a peripheral profile. When the first engagement element 12 moves toward the first engagement segment 27, it performs an oscillating movement during a rotation of the cam element 10. The first engagement element 12 reaches a maximum angle of oscillation on one of the raised areas. The first engagement element 12 reaches a minimum angle of oscillation in a center between two raised areas. The first slotted guide track 14 is provided for the purpose of moving the first engagement element 12 in an oscillating manner in a radial direction 19 of the cam element 10 when the cam element 10 rotates in the first switching position.

The first adjusting segment 28 is adjacent to the first engagement segment 27. The first adjusting segment 28 has a direction with a radial and an axial component. The cam element 10 can be displaced axially by the axial component. A radial depth of the first adjusting segment 28 corresponds to a radial depth of the first engagement segment 27. A radial height of a first guide wall 29 of the first adjusting segment 28 remains constant.

The adjusting device 11 comprises a second engagement element 13. The second engagement element 13 is provided for the purpose of displacing the cam element 10 axially into a second switching position. The adjusting device 11 is arranged on a free longitudinal end 26 of the camshaft 22. The second engagement element 13 is cylindrical.

The adjusting device 11 has a second slotted guide track 15. The second slotted guide track 15 is spaced apart axially from the first slotted guide track 14. The second slotted guide track 15 has different segments. One segment forms a second engagement segment 30. A second engagement segment 30 runs in the circumferential direction and has a distance to the main axis of rotation 23 that remains constant in the circumferential direction. A second adjusting segment 31 is adjacent to the second engagement segment 30. The second adjusting segment 31 has a direction with a radial and an axial component. The cam element 10 can be displaced axially by the axial component. The second adjusting segment 31 is spaced apart farther from the main axis of rotation 23 than the second engagement segment 30.

A step is formed between the second engagement segment 30 and the second adjusting segment 31 over an entire circumference. A height of a second guide wall 32 of the second adjusting segment 31 decreases in the circumferential direction. The second adjusting segment 31 is provided for the purpose of guiding the second engagement element 13 along the second guide wall 32 into the engagement segment 30 when the second switching position is activated. The cam element 10 is thus displaced axially. The second guide wall 32 forms an acute angle in relation to a main plane of rotation of the cam element 10. The main plane of rotation runs perpendicular to the main axis of rotation 23.

Figure 3:
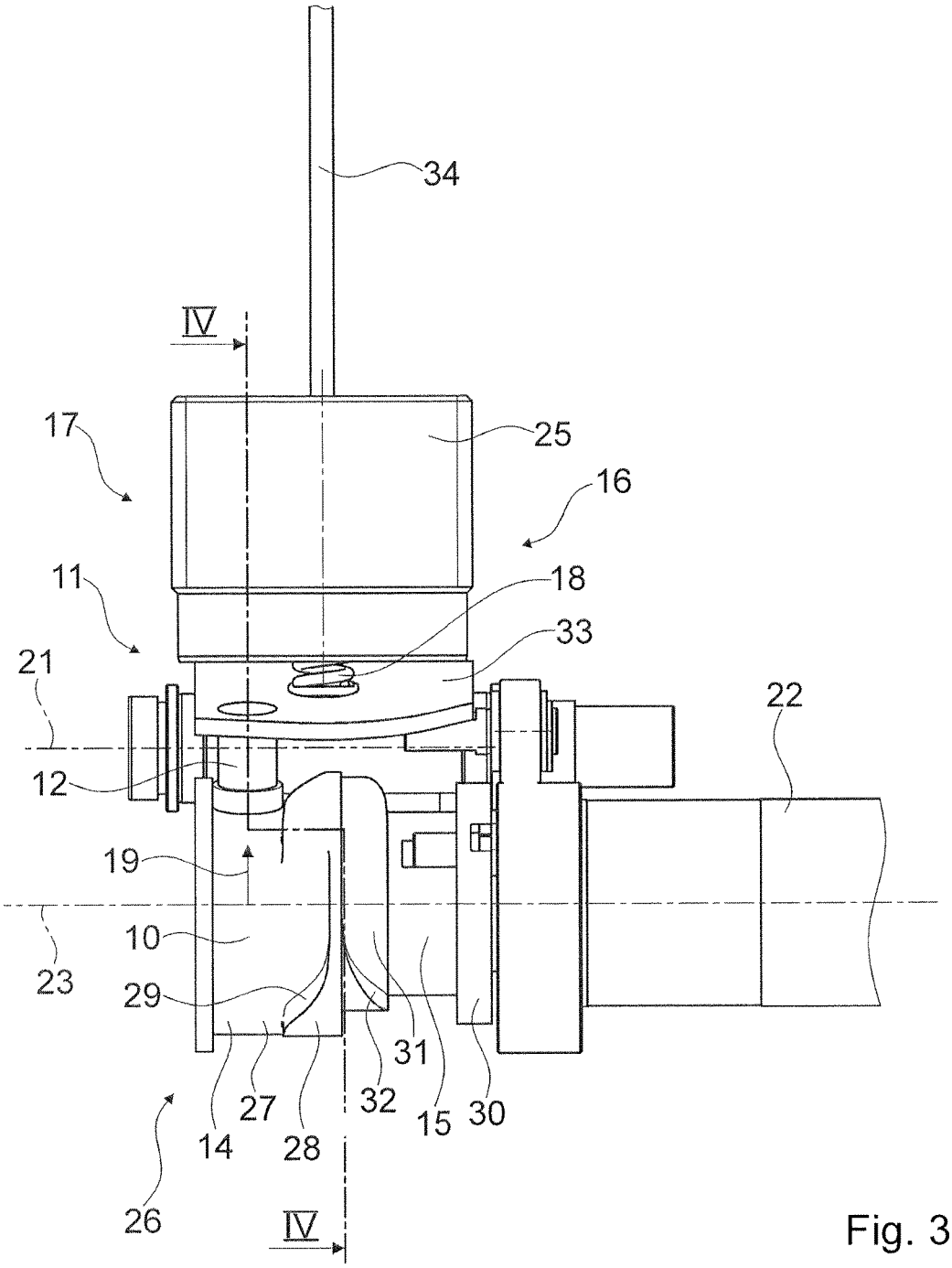
FIG. 3 shows a side view of the valve drive device in a maximum angle of oscillation.
Figure 4:
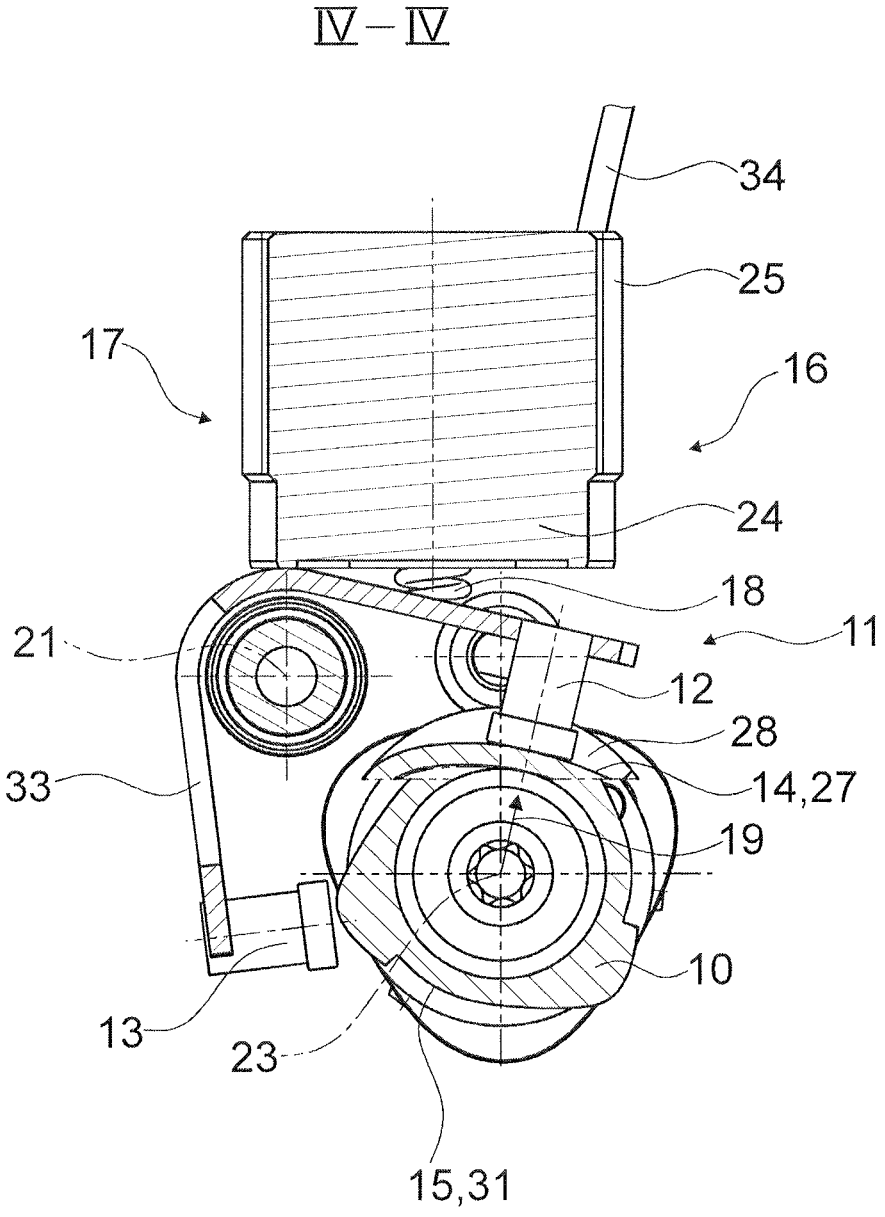
FIG. 4 shows the valve drive device in a sectional view through IV-IV.
Figure 5:
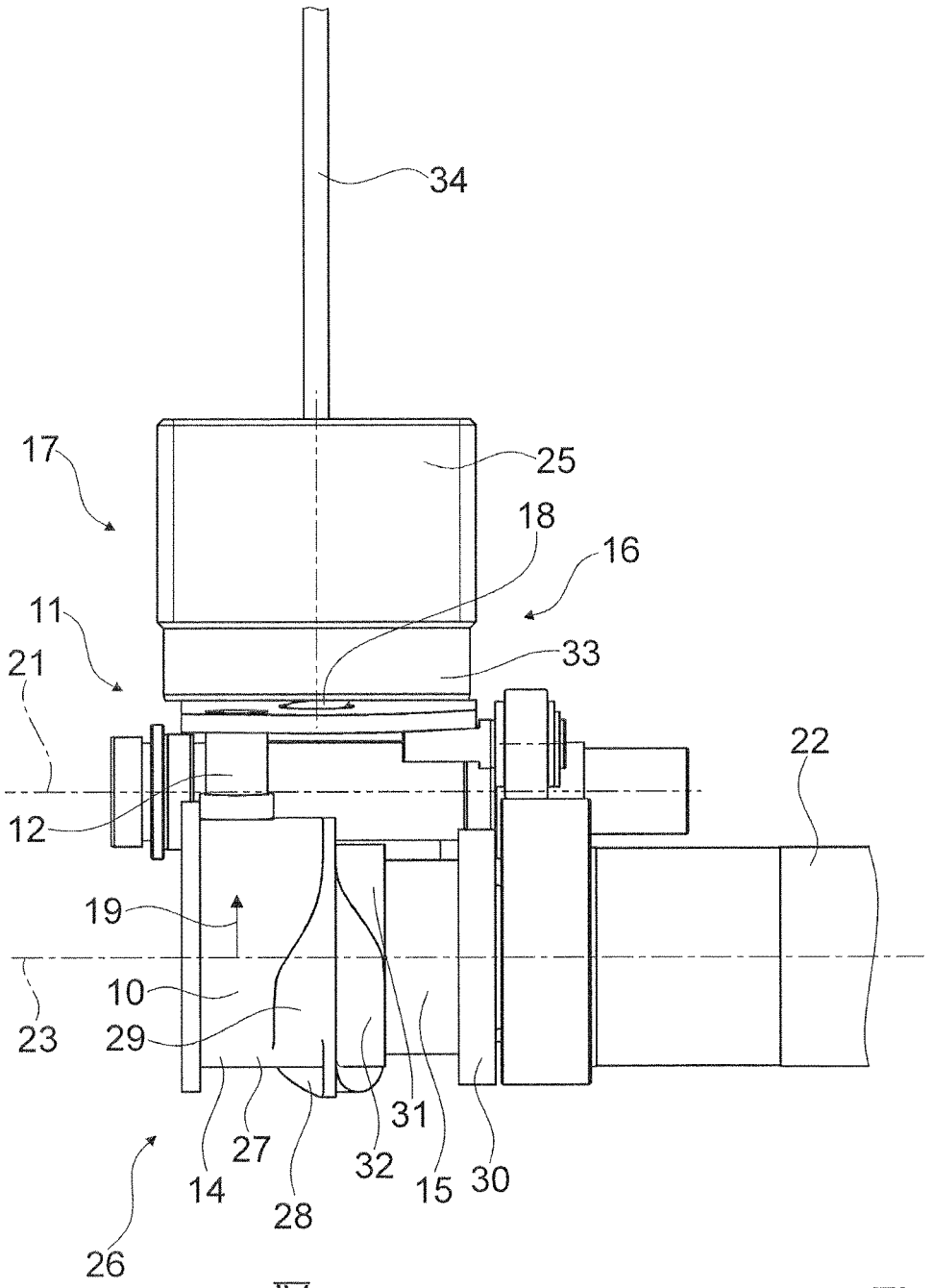
FIG. 5 shows another side view of the valve drive device in a minimum angle of oscillation.

In the first switching position, the first engagement element 12 is guided in the first slotted guide track 14. The valve drive device is then in a firing mode. The first engagement element 12 is moved up and down on the first slotted guide track 14 in a radial direction. FIG. 3 shows the first engagement element 12 with a maximum angle of oscillation. Here, the first engagement element 12 is closest to the main axis of rotation 23. As shown in FIG. 4, the engagement element 12 is located between two raised areas of the first engagement segment 27. As the cam element 10 continues to rotate, one of the raised areas presses the first engagement element 12 away from the main axis of rotation 23. FIG. 5 shows the first engagement element 12 with a minimum angle of oscillation. Here, the first engagement element 12 is spaced apart farthest from the main axis of rotation 23. The first engagement element 12 lies on one of the raised areas of the first engagement element 27.

During firing mode, the second engagement element 13 is spaced apart from the second slotted guide track 15. The first engagement element 12 is embodied so as to be positively coupled with the second engagement element 13. The adjusting device 11 comprises a lever element 33. The lever element 33 supports the first engagement element 12 and the second engagement element 13 about a common swivel axis 21. The common swivel axis 21 runs parallel to the main axis of rotation 23 of the cam element 10.

The triggering device 16 comprises a return spring 18. The return spring 18 loads the first engagement element 12 with a restoring force. The return spring 18 is provided here in order to exert restoring force on the first engagement element 12 in the direction of the first slotted guide track 14. The return spring 18 forms a helical compression spring. The restoring force is aligned radially in the direction of the cam element 10.

Figure 6:
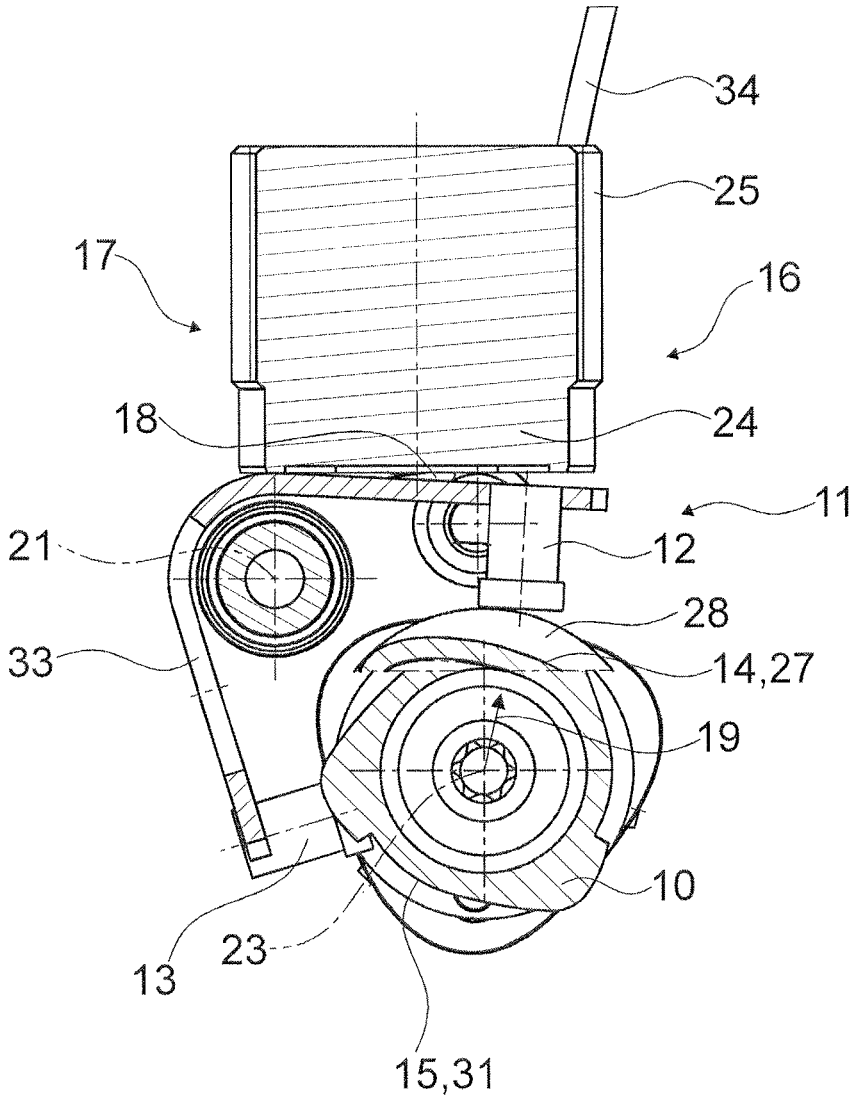
FIG. 6 shows a sectional view of the valve drive device in a release operation.

The adjusting device 11 comprises a triggering device 16. The triggering device 16 is provided to change the operating mode. More precisely, the triggering device 16 is provided to activate an engine-braking mode. For this purpose, the triggering device 16 holds the first engagement element 12 against the restoring force (FIG. 6). The triggering device 16 comprises an electromagnet 17 for this purpose. The electromagnet 17 is provided for the purpose of holding the first engagement element 12 in the second switching position against the restoring force. The electromagnet 17 can be controlled electrically over a cable 34.

The triggering device 16 is provided for the purpose of providing a release force that extends radially starting from the cam element 10. In this exemplary embodiment, the release force corresponds to a magnetic retention force. Starting radially from the main axis of rotation 23, the electromagnet 17 is arranged behind the first engagement element 12. The electromagnet 17 attracts the first engagement element 12 in an activated state. The electromagnet 17 comprises a solenoid 24. The electromagnet 17 further comprises a solenoid housing 25 in which the solenoid 24 is arranged. The return spring 18 is arranged within the solenoid housing 25. The return spring 18 is enclosed by the solenoid 24. The return spring 18 is arranged coaxially to the solenoid 24.

The first engagement element 12 is arranged in such a way in relation to the triggering device 16 that the restoring force in a portion 20 of the range of motion of the first engagement element 12 is greater than a release force of the triggering device 16 acting on the first engagement element 12. A distance between the electromagnet 17 and a magnetic force of the electromagnet 17 are set up by a person skilled in the art such that the release force exceeds the restoring force only in the range of the minimum angle of oscillation.

For example, if the electromagnet 17 is activated in the range of the maximum angle of oscillation, the triggering device 16 does not release, since the magnetic force acting on the engagement element 12 is less than the restoring force of the return spring 18. As the angle of oscillation decreases and the first engagement element 12 consequently moves closer to the electromagnet 17, the effect of the magnetic force on the first engagement element 12 increases and finally exceeds the restoring force in a close range. The first engagement element 12 is then pulled to the electromagnet 17.

Figure 7:
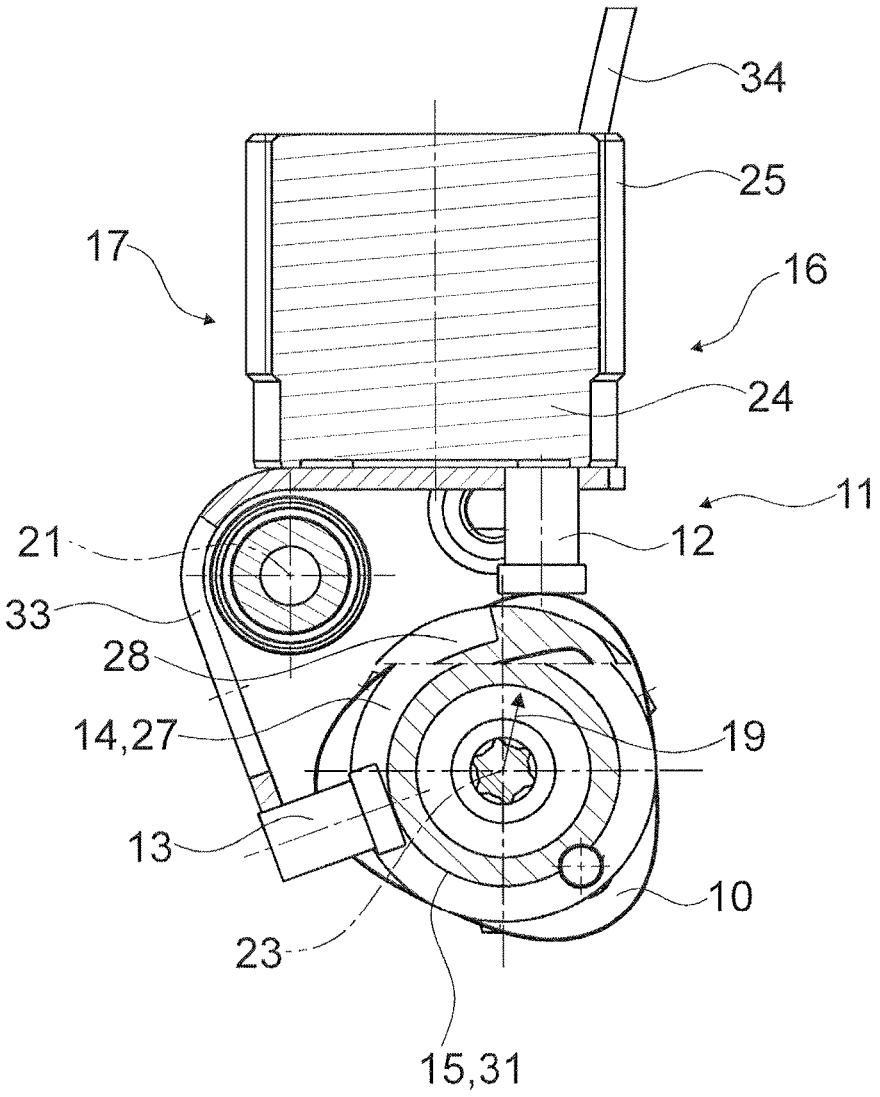
FIG. 7 shows a sectional view of the valve drive device in an engaging operation.

The second engagement element 13 is placed by the lever element 33 at the second slotted guide track 15. As a result of the second engagement element 13 resting against the second guide wall 32, the cam element 10 is displaced axially and then moves into the second engagement segment 30. This locks the cam element 10 axially (FIG. 7). The second switching position has now been assumed. In the second switching position, the first engagement element 12 rests against the electromagnet 17.

To switch back into the first switching position, the electromagnet 17 is switched off. The return spring 18 is provided for the purpose of guiding the first engagement element 12, after the electromagnet 17 is switched off, into the first slotted guide track 14 in order to perform a switching operation into the first switching position. If the electromagnet 17 fails, the switching operation into the first switching position also occurs.

Figure 8:
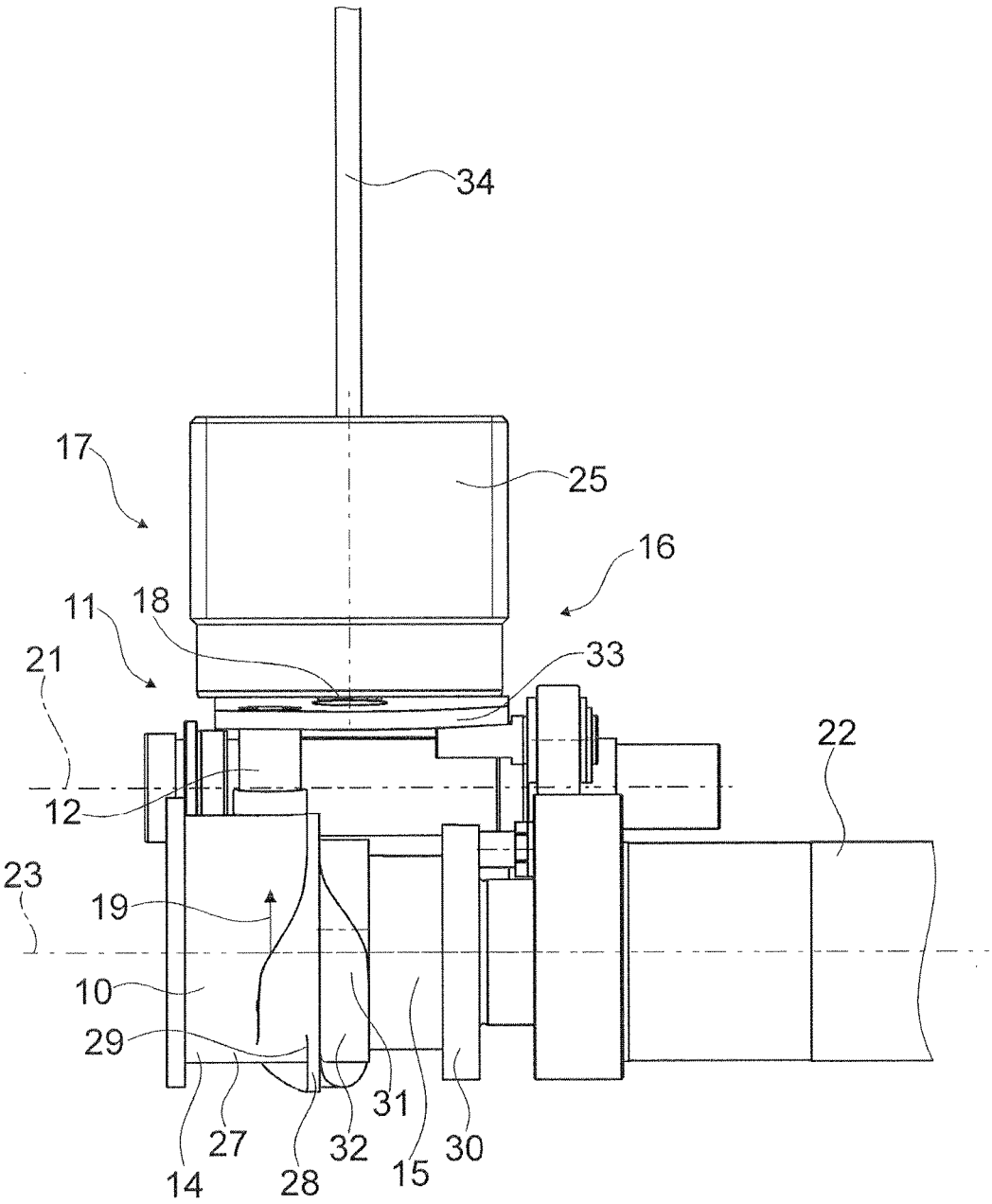
FIG. 8 shows another side view of the valve drive device in a displacing operation.
Figure 9:
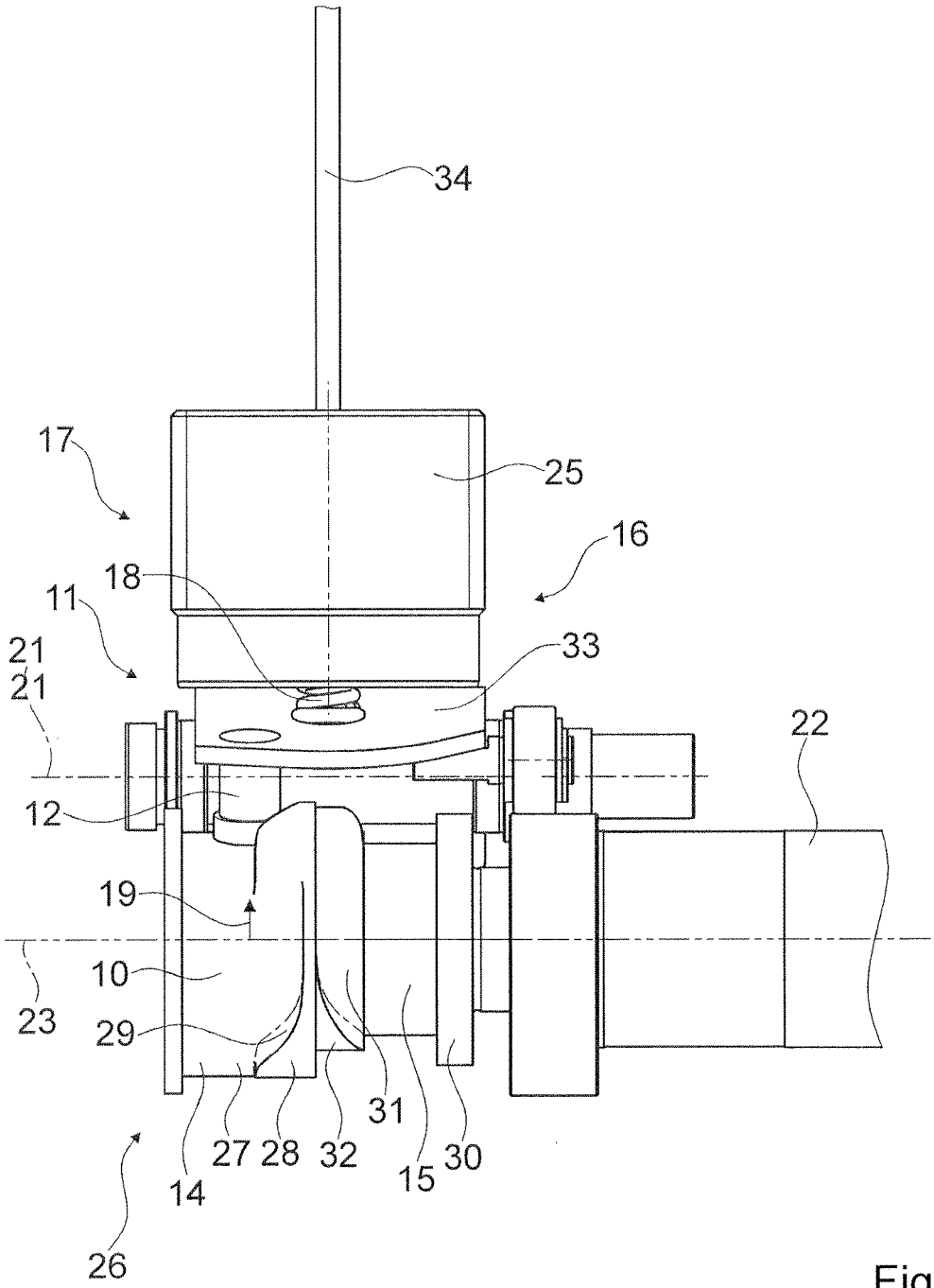
FIG. 9 shows another side view of the valve drive device in a shut-down operation.

As shown in FIG. 8, after the electromagnet 17 is switched off, the return spring 18 presses the first engagement element 12 onto the first slotted guide track 14. The first engagement element 12 is then located at the axial level of the adjusting segment 28. When the first guide wall 29 is reached, the cam element 10 is displaced axially (FIG. 9). Finally, the cam element 10 is located in the first engagement segment 27.

LIST OF REFERENCE SYMBOLS

10 cam element
11 adjusting device
12 engagement element
13 engagement element
14 slotted guide track
15 slotted guide track
16 triggering device
17 electromagnet
18 return spring
19 radial direction
20 portion of range of motion
21 swivel axis
22 camshaft
23 main axis of rotation
24 solenoid
25 solenoid housing
26 longitudinal end
27 engagement segment
28 adjusting segment
29 guide wall
30 engagement segment
31 adjusting segment
32 guide wall
33 lever element
34 cable

The invention claimed is:

1. A valve drive device for an internal combustion engine, comprising:

an axially displaceable cam element; and an adjusting device including a first engagement element that displaces the axially displaceable cam element axially into a first switching position and a second engagement element that displaces the axially displaceable cam element axially into a second switching position;

wherein the adjusting device has a first slide track in which the first engagement element is guided in the first switching position and a second slide track in which the second engagement element is guided in the second switching position and wherein the first engagement element is positively coupled with the second engagement element;

wherein the adjusting device includes a triggering device that holds the first engagement element in the second switching position against a restoring force;

wherein the first slide track moves the first engagement element in an oscillating manner in a radial direction of the axially displaceable cam element during a rotation of the axially displaceable cam element in the first switching position.

2. The valve drive device according to claim 1, wherein the triggering device includes an electromagnet that holds the first engagement element in the second switching position against the restoring force.

3. The valve drive device according to claim 1, wherein the triggering device includes a return spring that exerts the restoring force on the first engagement element in a direction of the first slide track.

4. The valve drive device according to claim 3, wherein the return spring guides the first engagement element, after an electromagnet of the triggering device is switched off, into the first slide track to perform a switching operation into the first switching position.

5. The valve drive device according to claim 1, wherein the first engagement element is disposed in relation to the triggering device such that the restoring force in a portion of a range of motion of the first engagement element is greater than a release force of the triggering device acting on the first engagement element.

6. The valve drive device according to claim 1, wherein the adjusting device includes a lever element that supports the first engagement element and the second engagement element about a common swivel axis.

7. The valve drive device according to claim 1, wherein a camshaft supports the axially displaceable cam element in a rotationally fixed manner and wherein the adjusting device is disposed on a free longitudinal end of the camshaft.

8. An internal combustion engine comprising an engine brake that has a valve drive device according to claim 1.

9. A method for axially displacing a rotating cam element from a first switching position into a second switching position by an adjusting device with a first engagement element positively coupled with a second engagement element, comprising the step of:

moving the first engagement element in an oscillating manner in a radial direction of the rotating cam element by a first slide track of the adjusting device during a rotation of the rotating cam element in the first switching position.

* * * * *